United States Patent [19]

Taylor et al.

[11] Patent Number: 4,958,891

[45] Date of Patent: Sep. 25, 1990

[54] SPLIT DRAWER ASSEMBLY

[75] Inventors: Marc D. Taylor, Columbus, Ohio; Duane Beardsley, Berrien Springs, Mich.

[73] Assignee: Artromick International, Inc., Columbus, Ohio

[21] Appl. No.: 348,193

[22] Filed: May 5, 1989

[51] Int. Cl.[5] ..... A47B 81/00

[52] U.S. Cl. ..... 312/287; 211/175; 312/348

[58] Field of Search ..... 312/286, 287, 350, 343, 312/344, 346, 347, 348; 211/175; 108/102, 143

[56] References Cited

U.S. PATENT DOCUMENTS

| | | | |
|---|---|---|---|
| 905,737 | 12/1908 | McCombe | 108/102 |
| 4,482,066 | 11/1984 | Dykstra | 312/348 X |
| 4,822,116 | 4/1989 | Relyea et al. | 312/287 |

*Primary Examiner*—Joseph Falk

*Attorney, Agent, or Firm*—Wood, Herron & Evans

[57] ABSTRACT

A storage platform inserted into a frame and accessible from both ends thereof. More specifically, the platform may be configured as a drawer assembly which allows access to the assembly from either end of a drawer storage frame, one side of which may be withdrawn from the storage frame without rearward travel of the remaining portion of the assembly.

11 Claims, 3 Drawing Sheets

SPLIT DRAWER ASSEMBLY

FIELD OF THE INVENTION

The invention relates to a storage platform inserted into a frame, which may be accessed from either end thereof. More narrowly, the invention relates to a drawer inserted into a medication cart used in hospitals, nursing homes and other long term health care facilities, which may be accessed from either side of the medication cart.

BACKGROUND OF THE INVENTION

The present invention is directed to a storage platform for use in a frame which would permit access to both sides of the storage platform. One type of storage platform within the scope of the invention is a drawer assembly, and one frame with which one or more drawer assemblies can be used is a medication cart for the dispensing of pharmaceuticals. One manufacturer of medication carts is Artromick International, Inc., Columbus, Ohio which produces various lines of carts, such as the MD Series. Certain of the Artromick medication carts have drawer guide systems comprised of opposed pairs of horizontal slots running the length of the medication cart from front to back, i.e., side to side. Where the medication cart is designed for dual-sided access, a drawer assembly inserted into one pair of horizontal slots can be passed completely through the medication cart from one side through the other.

Drawers capable of passing "straight through" the medication cart have certain advantages in the dispensing of the various medications employed in a hospital, nursing home or other long term health care facility. The "straight through" drawer can be completely removed and thereby easily restocked, and/or moved to another pair of slots. Also, the "straight through" drawers are accessible from either side of the medication cart, permitting access without the need of rotating the cart 180°. This is an important consideration in hospital rooms and corridors where maneuver space is not always available. Also, the "straight through" drawer does not need rollers, bearings, or lubrication in the individual drawer guides for movement through the horizontal slots in the medication cart.

However, the straight through drawers suffer from several perceived disadvantages by some users. Because the drawer freely slides in the drawer guide system of the medication cart, it is possible to inadvertently pull the drawer beyond the point where the guides in the drawer still mate with the drawer guides, and thereby spill and/or break the stored contents as the drawer falls from the medication cart. Also, when the drawer is pulled out from one side of the medication cart, one cannot readily access the drawer from the other side. In a related problem, as the straight through drawer is pulled out from one side, the contents of the drawer below become exposed on the opposite side, making possible the unauthorized removal of pharmaceuticals from the medication cart.

It is an object of this invention to provide a drawer assembly for use in a drawer guide system medication cart which permits partial withdrawal of one side of the drawer assembly without rearward movement of the other side of the drawer.

It is a further object of this invention to provide a drawer assembly which is accessible from either end of a frame, such as a medication cart, without the risk of accidental spillage of the drawer contents.

It is an advantage of the invention that the drawer assembly requires no lubrication and has no roller wheels or bearings which might damage or soil the user's clothing.

These and other objects and advantages will be further explained and described in the following text and drawings in which:

BRIEF DESCRIPTION OF THE INVENTION

Figure 1:
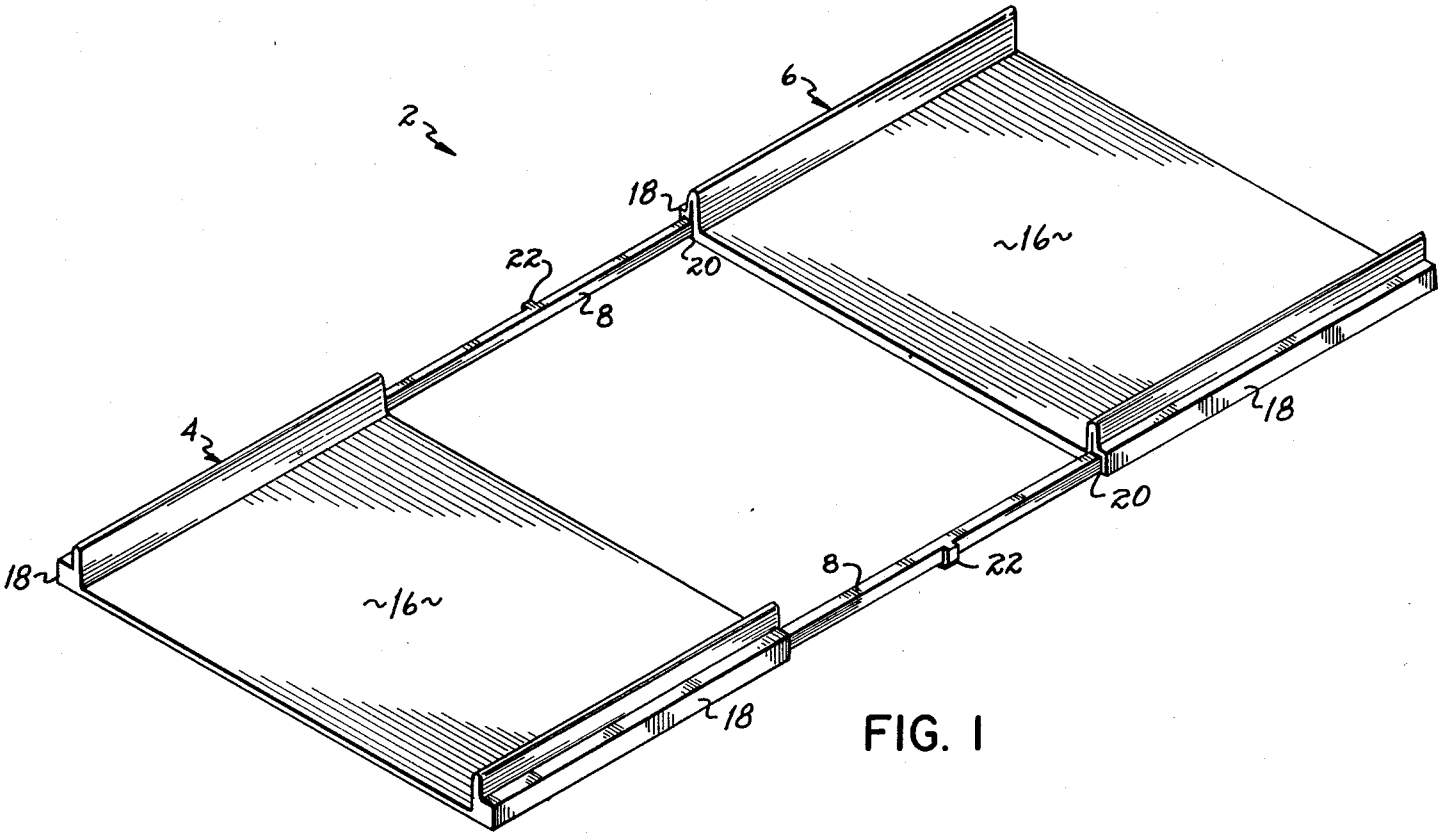
FIG. 1 is a perspective view of the storage platform.

The invention relates to a storage platform inserted into a frame which is accessible from both ends thereof, wherein one section of the platform may be withdrawn from the frame without rearward travel of the remaining section. More narrowly, the invention relates to a split drawer assembly for insertion into a medication cart which is accessible from both ends thereof, wherein one portion of the drawer assembly is slidably withdrawn from the medication cart without rearward travel of the remaining drawer portion.

The storage platform is comprised of two discrete storage sections connected by tubular members located within channels along the edges of the individual storage sections. Guides on both sides of the storage platform sections slide along mating slots of the frame. Rearward travel of either of the storage platform sections is prevented by projections on the platform sections which prevent further movement of the guides through the slot of the frame.

In applying the invention to use with a medication cart, the split drawer assembly described herein allows the contents of the drawer to be accessed from either side of the medication cart. Further, withdrawing a drawer portion from one side of the medication cart does not withdraw the opposite side of the assembly into the medication cart and thereby expose medications stored in the drawer unit below. Also, the tubular members connecting the drawer assembly portions are located interior to the guides of the drawer portions. Thus, the risk of injury due to the movement of exposed parts as the drawer is alternately withdrawn from and replaced into the cart is minimized, as is the risk of soiling or damaging clothing.

DETAILED DESCRIPTION OF THE INVENTION

The invention in its broader aspects relates to a storage platform for insertion into a frame allowing access to the platform from either end thereof, comprising a first section having a platform surface, guides on each side of the platform surface, and a channel within at least one guide; a second section opposed to the first section having a platform surface, guides on each side of the platform surface, and a channel within at least one guide mateable end on with the channel of the first section; and a tubular member inserted into each set of mating channels of the first and second sections and secured therein, having tabs near both ends thereof to limit travel of the first section relative to the second section. Rearward travel of either of the first or second sections of the storage platform into the frame is prevented by use of at least one projection on each of the first and second sections.

The invention more narrowly relates to a drawer assembly in a slotted frame, such as a medication cart, having access from either end of the drawer assembly, comprising a first storage portion having a face, guides on each side of the first storage portion approximately perpendicular to the face and a channel within at least one guide; a second storage portion opposed to the first storage portion having a face, guides on each side of the second storage portion approximately perpendicular to the face, and a channel within at least one guide mateable end on with the channel of the first storage portion; and a tubular member inserted into each set of mating channels of the first and second storage portions and secured therein, having tabs near both ends thereof to limit travel of the first storage portion relative to the second storage portion. As with the storage platform, rearward travel of the storage portions is prevented by placement of at least one projection on each portion near the face of the portion. It is preferred that each guide of each storage portion have a channel located therein.

Referring to the drawings, FIG. 1 depicts a storage platform 2 comprised of a first section 4, and a second section 6 connected by tubular members 8. Each of the sections 4 and 6 have a platform surface 16, guides 18, and channels 20, through which run the tubular members.

The storage platform 2 is designed for use in a frame (not shown) having at least one pair of slots on which the guides 18 run. When either section 4 or 6 is extended from the other, exposing tubular members 8, the weight of that section extended from the frame tends to exert a downward bending force on the tubular members 8. To minimize flex of the tubular members 8, to maintain the extended section in an approximately horizontal orientation, and further to facilitate travel of the tubular members 8, spacers 22 are provided on the tubular members 8 below and to the outside thereof approximately at the midpoint of the tubular members. The spacers 22 contact the slots of the frame when a section 4 or 6 of the storage platform 2 is extended, to limit the bending motion on the tubular members 8. The spacers 22 in FIG. 1 are depicted as integrally formed onto the tubular members. In an alternative embodiment, depicted below, the spacers are connected to the tubular member 8 by riveting, welding, adhesively connecting, or the like.

It is envisioned that a storage platform of this type may be employed in a wide variety of applications, such as in audio-visual home entertainment cabinetry, in bar carts and free standing kitchen storage units, in tool chests, and the like. Broadly, the storage platform is envisioned to have use in those applications where access to either side of a frame is available and desirable.

Figure 2:
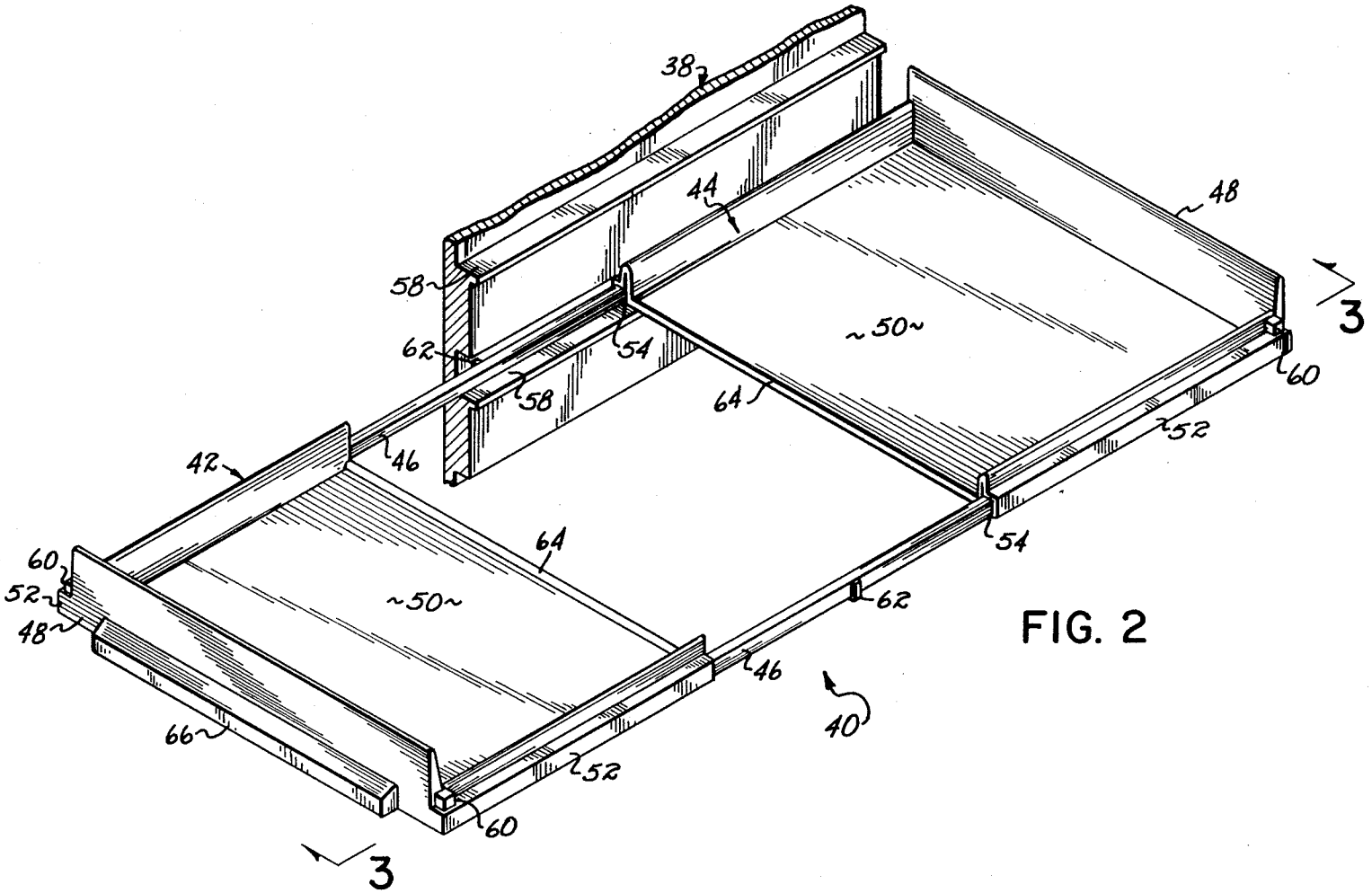
FIG. 2 is a perspective view of a split drawer assembly shown cooperating with a portion of a slotted frame.

One specific application wherein the invention has been used with great success is a splitdrawer assembly for dispensing drugs from a medication cart. In FIG. 2, the storage platform 2 of the broad concept takes the shape of a drawer assembly which was placed in a slotted frame, such as a medication cart 38. The drawer assembly 40 was comprised of a first storage portion 42, and a second storage portion 44 connected by tubular members 46. Each storage portion was comprised of a face 48, a bottom panel 50, guides 52 which were located on each side of the bottom panel 50 and approximately perpendicular to the face 48, and channels 54 within guides 52. Preferably, the length of tubular members 46 were slightly less than the combined length of channels 54 of both storage portions 42 and 44. In the embodiment as depicted, the storage portions 42 and 44 were molded from high impact styrene. It is envisioned that other structurally stable materials may be used with comparable results.

The guides 52 cooperated with slots 58 of the medication cart 38, a portion of which is depicted in FIG. 2. Projections 60 were located on guides 52 near the face 48.

As first storage portion 42 was withdrawn from the medication cart 38, thereby exposing a portion of the tubular members 46, rearward movement of the second storage portion 44 was prohibited by contact of the projections 60 on the second storage portion with the medication cart frame above the slot 58. Also, as the first storage portion 42 was withdrawn, downward bending force was exerted on the tubular members 46. To both support the tubular members 46 within slot 58 during extension of one of the storage portions as well as to facilitate travel of the tubular members 46 along slot 58, spacers 62 were affixed below and to the outside of the tubular members 46 at approximately the midway point of the tubular members. The spacers 62 in this embodiment were riveted to the tubular member 46. Alternatively, the spacers may be affixed by adhesive, welding, or by integral manufacture during the production phase of the tubular members themselves. Where the goods to be stored on the bottom panel 50 are susceptible to movement during the extension/retraction of the storage portions, a raised lip 64 was provided to discourage loss of contents from the moving storage portion to the drawer assembly below. To facilitate opening of one or the other of the storage portions 42 or 44, a handle 66 was provided on the face 48.

Figure 3:
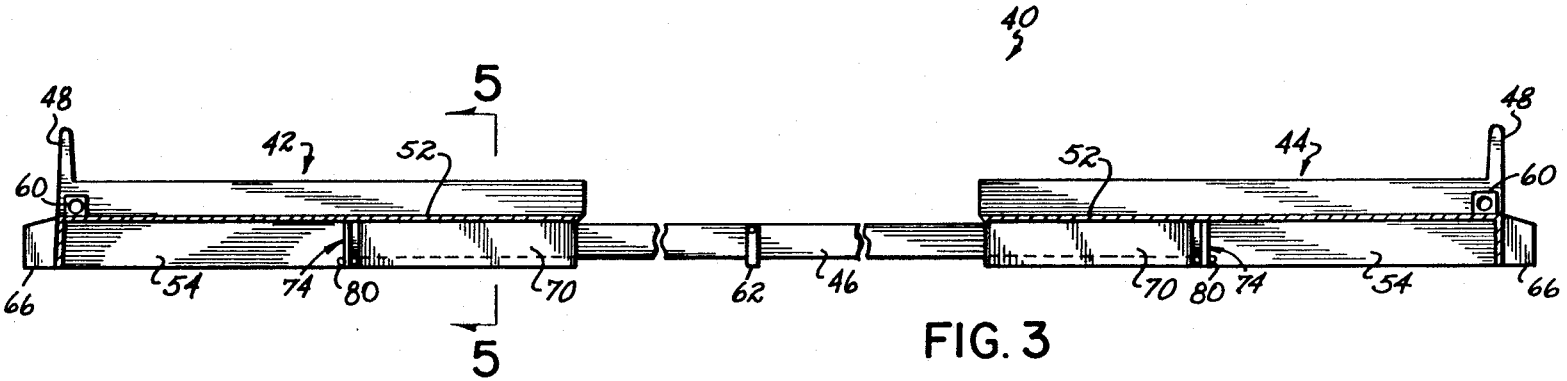
FIG. 3 is a partial cross-sectional view across lines 3—3 of FIG. 2 of an extended split drawer assembly or storage platform with the outside wall of one channel cutaway to show the cooperation between the tubular member and the channel.

FIG. 3 depicts the first and second storage portions in extended arrangement and shows the cooperation between the storage portions and tubular member 46. This depiction is shown for the drawer assembly, but the depictions here and in successive figures also apply to the storage platform of FIG. 1. The tubular member 46, which was produced from extruded aluminum having a square cross section, slid freely within channel 54 which was preferably square to match the shape of the tubular member 46. Alternatively, the tubular member 46 could be produced from reinforced resins such as glass-filled nylon, acetal and the like. Further, both the tubular member 46 and channel 54 may have cross-sections of different shapes. Preferably, the cross-sectional shape of both the tubular member 46 and channel 54 are identical.

Tubular member 46 was retained within channels 54 of the first and second storage portions 42 and 44 by cradle 70. The channel 54 in the depicted embodiment was rectangular and approximated an upside down "U" shape when viewed in cross-section. The cradle 70 in cross-section approximated a "U" shape and had outside dimensions roughly equivalent to the inside dimension of the channel 54. The tubular member 46 had an outside dimension slightly smaller than the inside dimension of the cradle 70 to permit free movement along the cradle 70. The cradle 70 was secured into the channel 54 by adhesive bonding, but may alternatively be force-fit into the channel, secured by heat sealing or the like. Alternatively, the storage portions 42 and 44 may be molded in, in such a way as to integrally form a cradle within channel 54.

Figure 4:
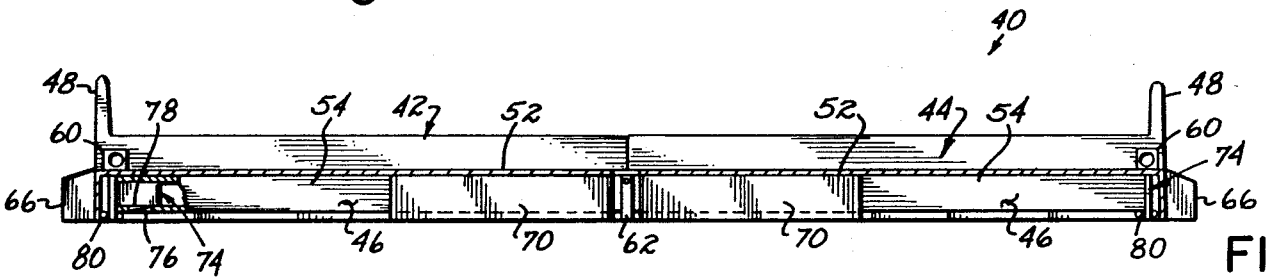
FIG. 4 is a partial cross-sectional view of a closed split drawer assembly or storage platform with the outside wall of one channel cutaway and a portion of the tubular member cutaway to show the cooperation between the tab and the tubular member.

Travel of the first storage portion 42 relative to the second storage portion 44 was limited by the use of tabs 74 inserted into the ends of tubular member 46, which stopped travel of the first storage portion 42 by the contact of cradle 70 with tabs 74, as shown in FIG. 4. Tubular member 46 in the depicted embodiment had a slot 76 into which prong 78 of the tab 74 was lockably inserted. The tab 74 was removed from the end of tubular member 46 by depressing the prong 78 to permit removal from slot 76. With the tab 74 removed, the tubular member 46 could be withdrawn from one or both of the storage portions 42 and 44.

Figure 5:
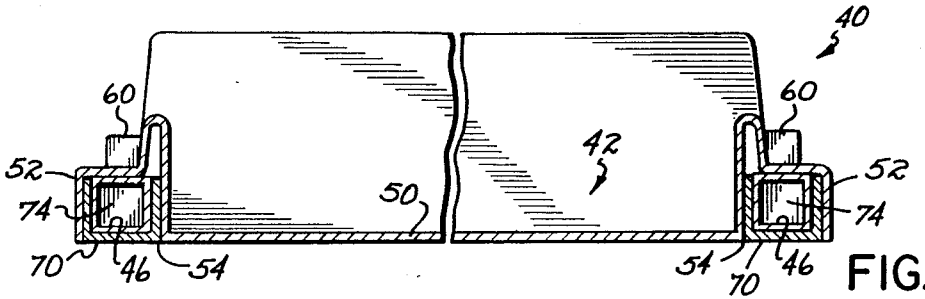
FIG. 5 is a cross-sectional view across lines 5—5 in FIG. 3 showing the spatial relationship of the tubular members to the cradles within the channels of the split drawer assembly or storage platform.

Placement of the drawer assembly 40 into the medication cart was effected by removing the tabs 74 from individual tubular members 46 on both sides of the assembly 40, preferably from the same storage portion, inserting the tubular members retained in the other storage portion into one side of the medication cart, inserting the remaining storage portion into the other side of the medication cart, and repositioning tabs 74 into the ends of tubular members 46 after threading through cradles 70. The interrelationship of the tubular member 46 with the cradle 70 and channel 54 is shown in more detail in cross-sectional FIG. 5.

The noise attributable to tabs 74 striking the end of channel 54 or the end of cradle 70 was decreased by placing a resilient material on the contact surfaces of tab 74, such as a rubber "O-ring" 80. The O-ring 80 also decreased the prospect of damage to the respective tab, channel end and cradle. Alternatively, the tubular member 46 may be produced from a reinforced resin material such as glass-filled nylon, acetal, or the like, which could be manufactured with a deformable end portion approximating the function of tab 74 in that the end portion would prohibit movement of the tubular member through cradle 70 without externally applied compression to the end portion of the tubular member.

The drawer assembly 40 and storage platform 2 as described and depicted have shown the use of tubular members within both sets of channels of the respective storage portions and sections. Alternatively, only one tubular member located within one set of channels is necessary for limiting travel of the first storage section or portion relative to the second section or portion. However, it can be seen that such an arrangement would be less stable. Also, the tubular member 46 as depicted was square in cross-section. Alternatively the member may have a circular, oval, rectangular, or other cross-sectional shape.

The storage platform described above is considered to have utility in a variety of applications wherein stored items must be accessed from either side of a frame unit. More narrowly, the split drawer assembly described above has been used advantageously in medication carts to allow access by an attendant from either side of the cart while providing the advantage that the contents of drawers below the split drawer assembly are not exposed when the overlying drawer is in use. It can be appreciated that the split drawer assembly can be made available for use in a variety of sizes. Drawer assemblies which, in the closed position, have dimensions of 17 inches by 24 inches from channel-to-channel and face-to-face have been employed to good effect.

Thus, it is apparent that there has been provided in accordance with the invention a split drawer assembly that fully satisfies the objects, aims, and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications and variations as fall within the spirit and broad scope of the appended claims.

What is claimed is:

1. A storage platform for insertion into a frame with slots therein allowing access to the platform from either end of the frame, comprising:

a first section having a platform surface, guides on each side of said platform surface which cooperate with slots in said frame, and a channel within at least one said guide;

a second section opposed to said first section having a platform surface, guides on each side of said platform surface which cooperate with slots in said frame, and a channel within at least one said guide mateable end-on with said channel of said first section; and a tubular member inserted into each set of said mating channels of said first and second sections, secured therein and slidable within said mating channels, having tabs near both ends thereof to limit travel of said first section relative to said second section.

2. The storage platform of claim 1 wherein said first and said second sections each have at least one projection thereon for preventing rearward travel thereof.

3. A drawer assembly for insertion into a drawer storage frame with slots therein which allows access to the drawer assembly from either end of the storage frame, comprising:

a first storage portion having a face, guides on each side of said first storage portion approximately perpendicular to said face which cooperate with slots in said drawer storage frame, and a channel within at least one said guide;

a second storage portion opposed to said first storage portion having a face, guides on each side of said second storage portion approximately perpendicular to said face which cooperate with slots in said drawer storage frame, and a channel within at least one said guide mateable end-on with said channel of said first storage portion; and a tubular member inserted into each set of said mating channels of said first and second storage portions, secured therein and slidable within said mating channels, having tabs near both ends thereof to limit travel of said first storage portion relative to said second storage portion.

4. The drawer assembly of claim 3 wherein said first and said second storage portions each have at least one projection thereon for preventing rearward travel thereof.

5. The drawer assembly of claim 3 wherein each said guide of each said storage portion has a channel therein.

6. The drawer assembly of claim 3 wherein said tubular member is extruded aluminum having a square cross-section.

7. The drawer assembly of claim 3 wherein said channels of said first and second storage portions are rectangular.

8. The drawer assembly of claim 3 wherein each said projection is above each said continuous guide near said face.

9. The drawer assembly of claim 3 wherein said tabs on said tubular member are removable.

10. A drawer assembly for insertion into a drawer storage frame with slots therein which allows access to the drawer assembly from either end of the storage frame, comprising:

a first storage portion having a face, continuous guides on each side of said first storage portion approximately perpendicular to said face which cooperate with slots in said drawer storage frame, channels within said continuous guides, and projections connected to said side of said face above said continuous guides for preventing rearward travel to said first storage portion;

a second storage portion opposed to said first storage portion having a face, continuous guides on each side of said second storage portion approximately perpendicular to said face which cooperate with slots in said drawer storage frame, channels within said continuous guides, and projections connected to each side of said face above said continuous guides for preventing rearward travel of said second storage portion, wherein said second storage portion in said opposed position results in mating end-on pairs of said channels of said first and second storage portions; and individual tubular members inserted into each said mating pair of channels of said first and second storage portions, secured therein and slidable within said mating pair of channels, having removable tabs near both ends thereof to limit travel of said first storage portion relative to said second storage portion.

11. The drawer assembly of claim 7 wherein each said tubular member has a spacer mounted thereto for limiting vertical movement of said tubular member in said drawer storage frame.

* * * * *